US005277391A

United States Patent [19]

Haug et al.

[11] Patent Number: 5,277,391

[45] Date of Patent: Jan. 11, 1994

[54] SHOWER HOLDER FOR USE WITH A WALL ROD

[75] Inventors: Andreas Haug; Thomas Schönherr, both of Stuttgart; Magdalena Faisst, Schiltach, all of Fed. Rep. of Germany

[73] Assignee: Hans Grohe GmbH & Co. KG, Schiltach, Fed. Rep. of Germany

[21] Appl. No.: 796,407

[22] Filed: Nov. 22, 1991

[30] Foreign Application Priority Data

Mar. 18, 1991 [DE] Fed. Rep. of Germany ..... 4108773

[51] Int. Cl.[5] ..... A47F 5/00

[52] U.S. Cl. ..... 248/219.3; 248/218.4; 248/230; 248/295.1; 4/605; 4/615

[58] Field of Search ..... 248/219.3, 218.4, 230, 248/295.1, 316.7, 75; 4/695, 605, 615

[56] References Cited

U.S. PATENT DOCUMENTS 2,621,968 12/1952 Vickroy ..... 248/229 X
3,933,329 1/1976 Granger ..... 248/295.1
4,174,822 11/1979 Larsson ..... 248/231 X
4,719,654 1/1988 Blessing ..... 4/615 X
4,914,759 4/1990 Goff ..... 4/605
4,964,573 10/1990 Lipski ..... 4/615 X

FOREIGN PATENT DOCUMENTS 2535891 8/1975 Fed. Rep. of Germany .
2857859 8/1979 Fed. Rep. of Germany .
3208707 3/1982 Fed. Rep. of Germany .
3506124 2/1985 Fed. Rep. of Germany .
9001494 4/1990 Fed. Rep. of Germany .

*Primary Examiner*—Robert W. Gibson, Jr.
*Attorney, Agent, or Firm*—Eckert Seamans Cherin & Mellott

[57] ABSTRACT

A shower holder for the mounting support of a hand-held shower on a wall rod contains a guidance element displaceably guided on the outside of the wall rod and whose length is at least twice as large as the wall rod diameter. With the aid of at least one strut a mounting support for the hand-held shower is fixed to the guidance element and has a spacing from the wall rod which is at least as large as the length of the guidance element.

36 Claims, 6 Drawing Sheets

SHOWER HOLDER FOR USE WITH A WALL ROD

BACKGROUND OF THE INVENTION

The invention relates to a shower or a shower head holder for use with a wall rod or bar.

It is known to fit hand-held showers by means of an adjustable mounting support to a wall rod, which is normally positioned vertically. The shower holder can be displaced along the wall rod. In many cases a pivoting or rotating of the shower on the shower holder is possible.

In a known shower holder of this type (DE-U-78 00 834), the wall rod has a circular cross-section, so that the shower holder can be rotated about the wall rod axis. The shower holder can be secured with the aid of an operating or control element for fixing the position. In addition, the shower holder can be pivoted about a direction perpendicular to the wall rod. Shower holders that are guided within the hollow wall rod are also known.

SUMMARY OF THE INVENTION

An object of the invention is to provide a shower holder for a wall rod, which can be moved very easily, but reliably remains in place on release.

As a result of the guidance cf the shower holder at two points, which have a considerable spacing from one another, the shower holder can be very easily manually moved without any tilting or blocking. The guidance can be made so easy that the shower holder can be moved with a very limited force. Despite this very easy movement, the shower holder does not move of its own accord, even when the actual shower or shower head is hung up. Thus, the large spacing between the mounting support for the shower and the guidance elements ensures that under the weight of the shower a tilting moment occurs, which is adequate for securing the shower holder.

The invention proposes in a further development that the mounting support is connected by means of a strut to the guidance element.

According to the invention the strut can be inclined with respect to the wall rod direction in such a way that the mounting support, considered in the longitudinal direction of the wall rod, is located roughly centrally between the two guidance points.

According to a further development, the mounting support is connected by means of two struts to the guidance element and in particular each strut engages on the guidance element in the vicinity of a guidance point. Thus in the vicinity of the guidance element, the two struts have a reciprocal spacing in the longitudinal direction of the wall rod, while they meet at the mounting support. In particular, the two struts can converge between the wall rod and the mounting support.

According to the invention, the mounting support can have a holding or retaining head, pivotable about an axis, for the shower. Such a holding head, which can optionally be provided with locking devices, is known from DE-C2-35 06 124. In particular, the holding head can be pivotable about an axis perpendicular to the longitudinal axis of the wall rod.

According to a further development of the invention, one strut is forked between the guidance element and the mounting support, which makes it possible to increase the pivoting range of the shower, because part of the shower, e.g. the shower tube or hose, can pass through between the two parts of the forked strut.

It is particularly advantageous if the strut leading upwards from the guidance element to the mounting support is forked, the fork being open in the vicinity of the mounting support. It is naturally also possible to guide the guidance element on the wall rod between the two widely spaced guidance points. In particular, at least in the vicinity of the two guidance points, the guidance element surrounds the wall rod and is guided on its outside.

According to a further development of the invention the guidance element has a tubular casing, which can be mounted on the wall rod. If the mounting support is connected with the aid of two struts to the guidance element casing, a substantially smooth-surface mounting support without projections is obtained, which can easily be grasped and also easily cleaned.

According to the invention, the friction between the guidance element and the wall rod is kept within narrow limits. It is e.g. possible to provide an adjusting device with the aid of which the friction and therefore the force necessary for displacement purposes can be adjusted once and for all. Optionally, it can also be readjusted at extended intervals.

It is also possible to release the non-positive fixing with the aid of an operating member.

If the guidance element casing has in its interior a tubular element which can be engaged on the wall rod, then according to the invention, the guidance element, and with it, the entire shower holder can be rotated about said tubular element and optionally within stop limits. This makes it possible to bring about an even finer adjustment of the displaceabiity of the shower mounting support, because then there is no movement between the tubular element and the wall rod on rotating. The possibility of rotating around a tubular element located in the guidance element is particularly advantageous if the wall rod does not itself have a circular cross-section.

According to the invention, the guidance element or its casing can be constructed as a gripping element, which can be used both for displacing and for rotating the shower holder. It is also advantageously possible to construct one or both struts between the guidance element and the mounting support as a gripping element.

In particular, the two struts and the guidance element casing can form a type of clip grip, which can be grasped at all points and which can be used for displacing or rotating the shower mounting support. This clip can have a triangular or U-shape.

According to the invention, the shower holder has a casing formed from two halves, which meet along a middle plane.

BRIEF DESCRIPTION OF THE DRAWINGS

Further features, details and advantages of the invention can be gathered from the following, non-limitative description of preferred embodiments of the invention and the attached drawings, wherein.

DETAILED DESCRIPTION OF THE PREFERRED EMBODIMENTS

Figure 1:
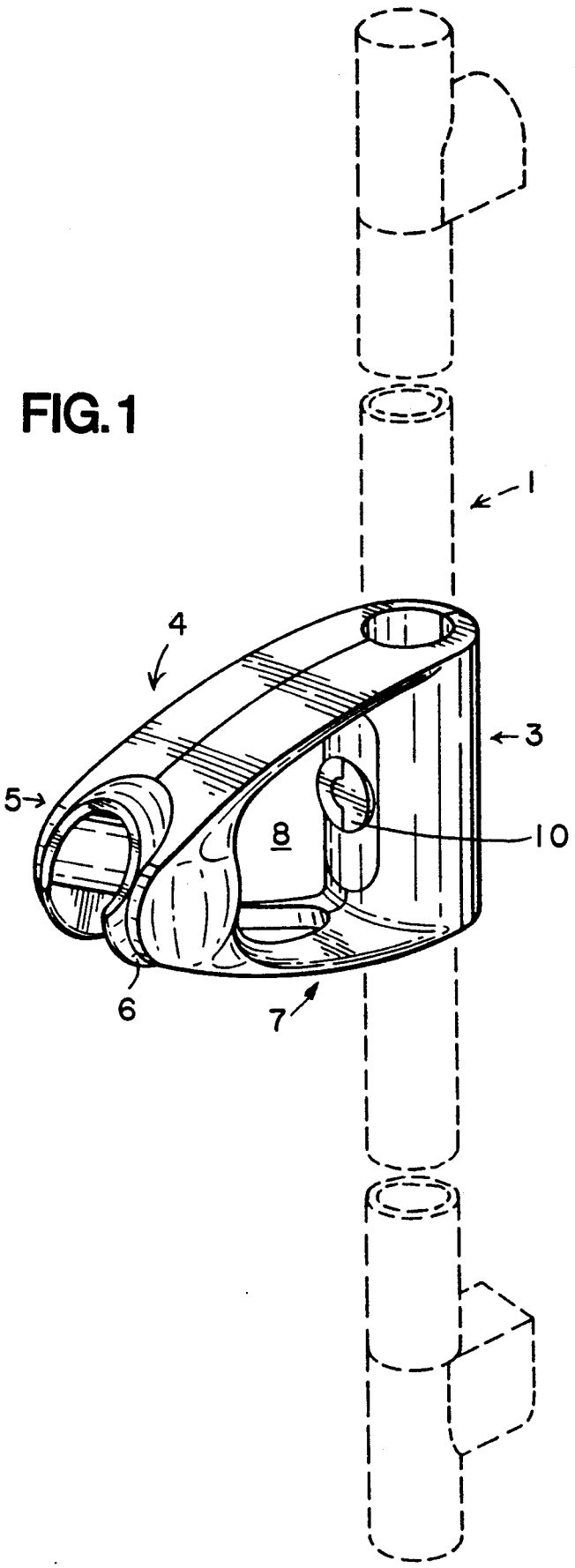
FIG. 1 is a perspective view of the shower holder according to the invention in association with a wall rod shown in phantom.
Figure 2:
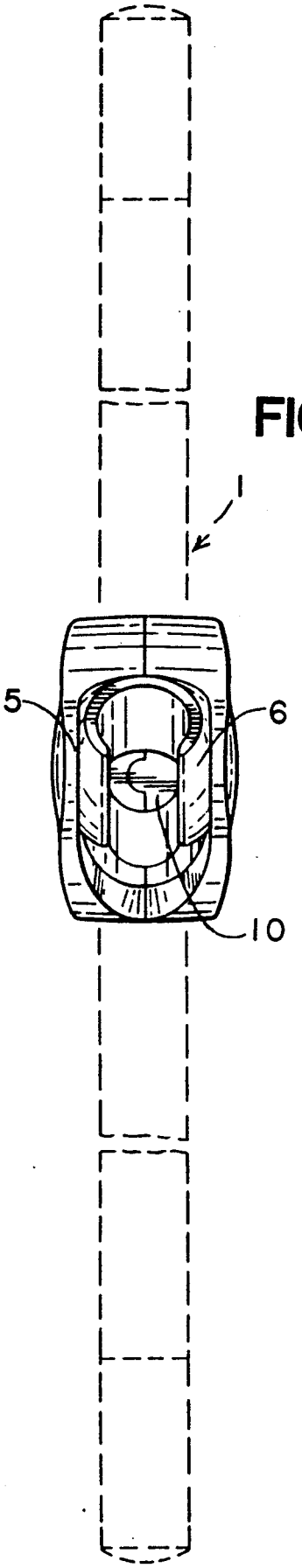
FIG. 2 is a front elevation view of the shower holder.
Figure 3:
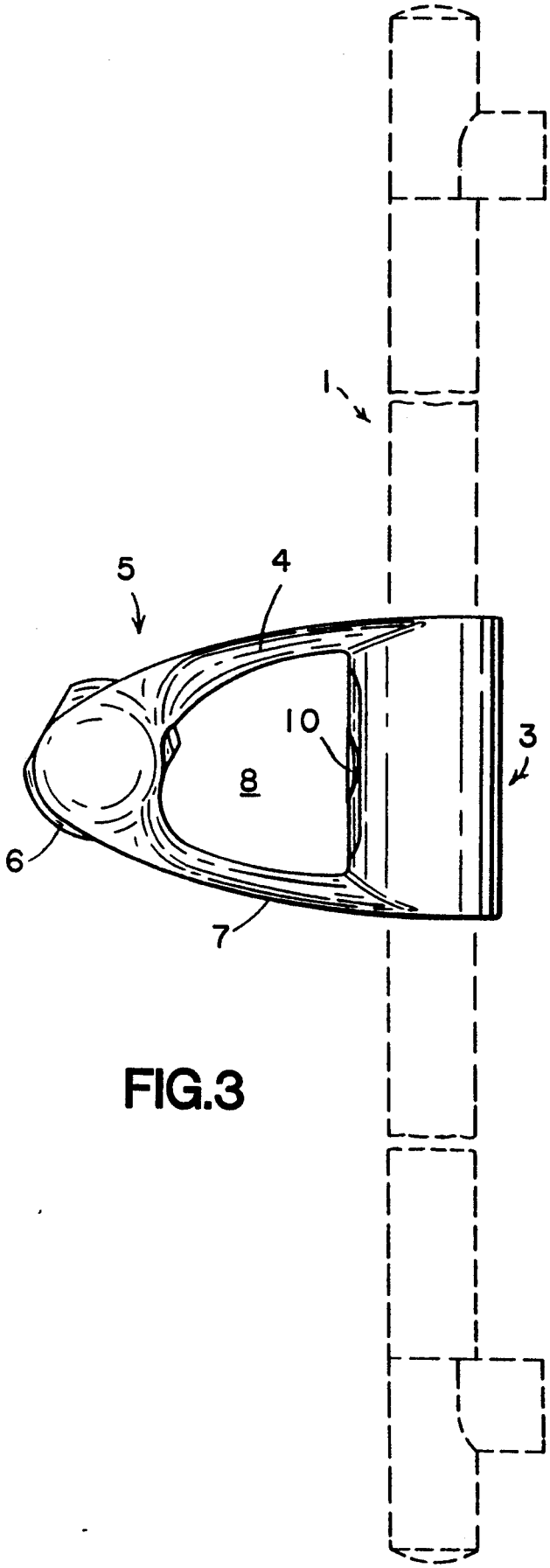
FIG. 3 is a side elevation view of the shower holder, illustrating a preferred transverse opening.

Referring to the figures, a vertically directed, cross-sectionally circular wall rod 1, which passes between corresponding mounting supports with a limited spacing from a not shown wall. The shower or shower head holder according to the invention, which has a casing constructed from two preferably symmetrical halves, is engaged on the wall rod.

The shower holder contains a guidance element 3 surrounding the wall rod 1 which has in the interior a cylindrical opening corresponding to the shape of the wall rod 1. In the vicinity of its upper end, the guidance element 3 has a slightly curved strut 4, which extends roughly perpendicularly away from the wall rod 1 and approaches the center of the longitudinal extension of the guidance element 3. In the front region, the strut 4 is provided with a mounting support 5 in which ran be inserted a holding or retaining head 6 for a shower. The mounting support 5 is connected by means of a further strut 7 to the lower region of the guidance element 3, and this lower strut 7 is also slightly curved. A passage 8 is provided between the two struts 4 and 7 and the guidance element 3, so that the two struts 4 and 7 and with the guidance element 3 form a clip or clamp.

Figure 8:
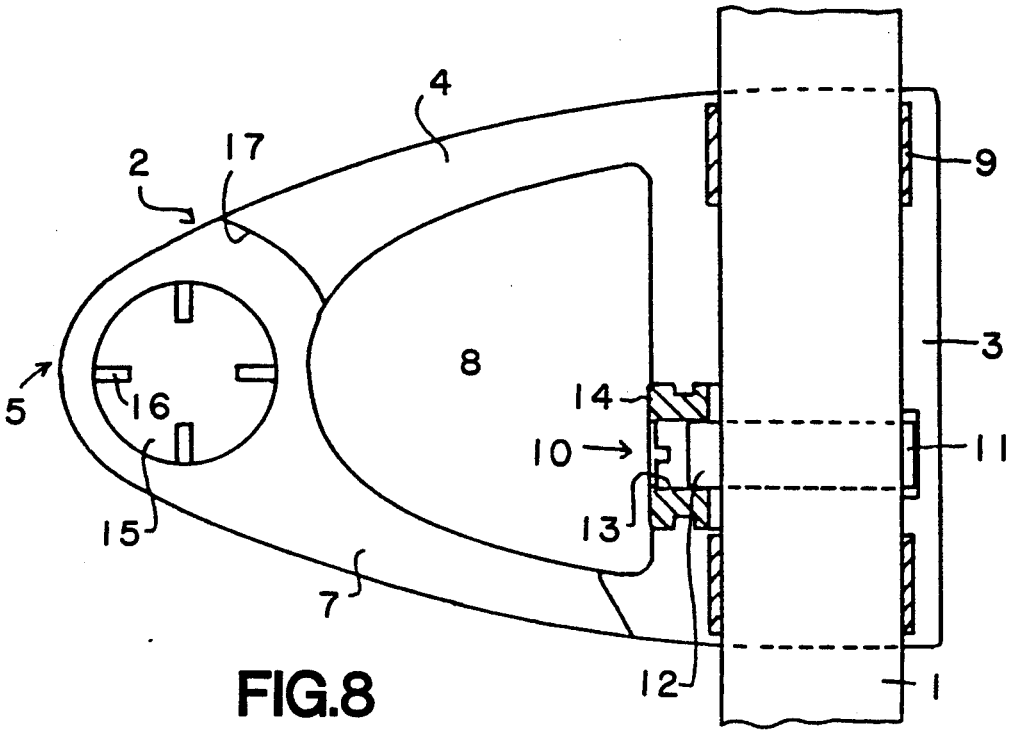
FIG. 8 shows a part sectional side view of half of a mounting support according to the invention.

Referring to FIG. 8, rings 9 are provided in the interior of the guidance element 3 and in the vicinity of its upper and lower end. The rings 9 engage directly on the outside of the wall rod 1. The rings 9 are used for guiding the shower holder or the guidance elements 3 on the wall rod 1 and can be made from plastic.

In the guidance element 3, an adjusting device 10 is provided with the aid of which the friction between the guidance element 3 and the wall rod 1 can be adjusted once and for all. The wall rod 1 is surrounded by a strip 11, which has a shoulder 12 provided with an external thread on the side of the guidance element 3 facing the mounting support 5. The thread of the shoulder 12 engages in the internal thread 13 of an axially fixed, but rotatable, clamp nut 14. The clamp nut 14 makes it possible to very sensitively adjust the force with which the strip 11 acts on the outside of the wall rod 1. The adjusting device 10 is adjusted in such a way that the shower holder can be displaced with a limited force.

In place of a strip wound around the wall rod or a tubular element, it would also be possible to use a pressure piece, in which case pressing and not pulling would take place.

In each half 2, the mounting support 5 contains a depression 15 with four radial ribs 16. In said depression 15 a locking device can be inserted for cooperating with the holding head 6. Such a locking device is known from DE-C-35 06 124.

Figure 9:
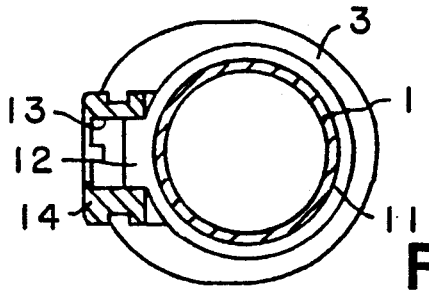
FIG. 9 shows diagrammatically a cross-section through the mounting support of FIG. 8.

FIG. 9 diagrammatically shows a cross-section through the mounting support. This shows how the strip 11 surrounds the wall rod 1 on all sides, so that a rotation of the clamp nut 14 strongly presses the strip 11 against the wall rod 1.

Figure 5:
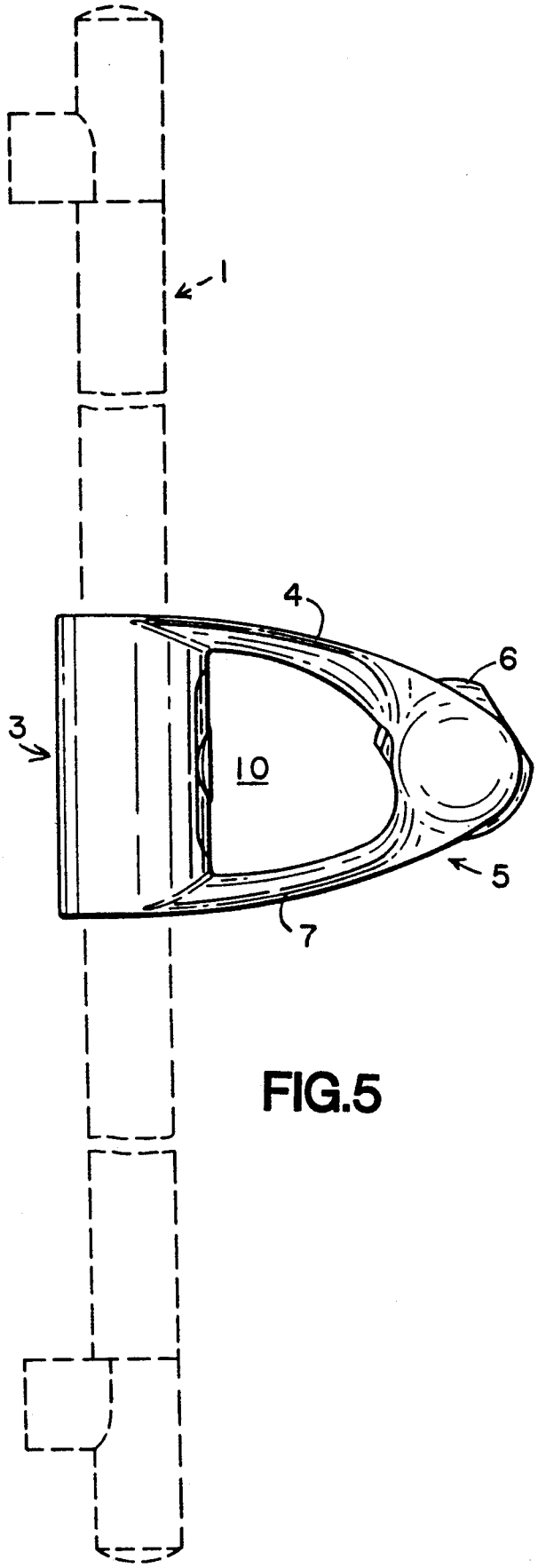
FIG. 5 is a side elevation view.
Figure 6:
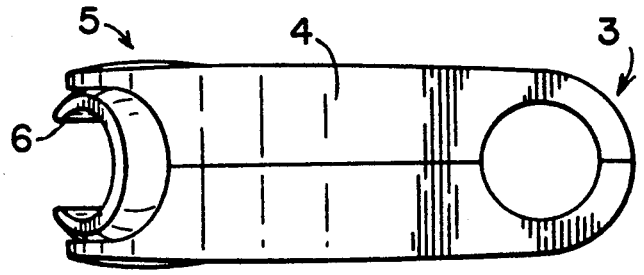
FIG. 6 is a top plan view.
Figure 7:
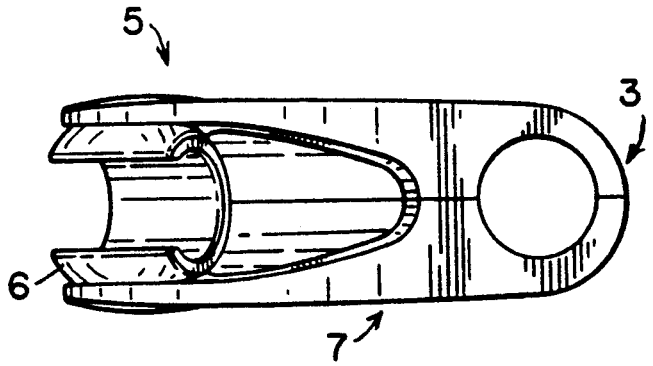
FIG. 7 is a bottom plan view, illustrating a preferred forked opening of a bottom strut.
Figure 10:
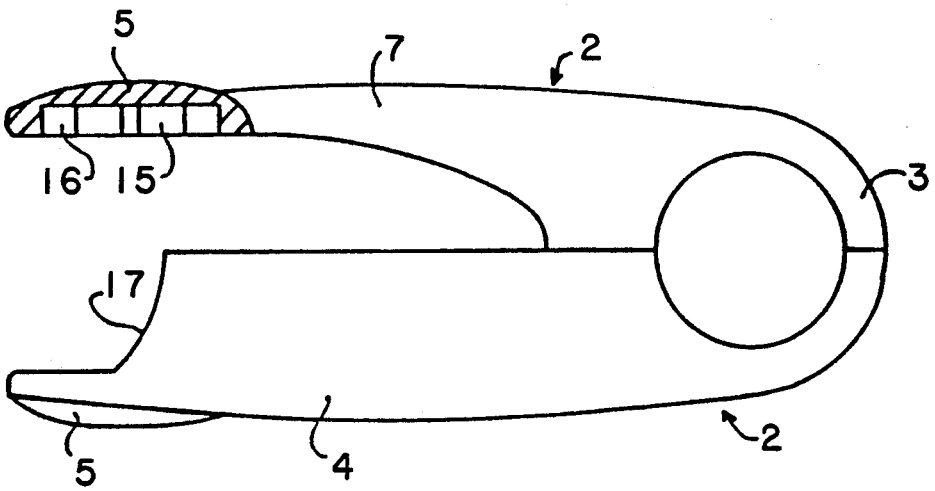
FIG. 10 shows a view of the mounting support from above or below.

In the upper half of FIG. 10, it is possible to see a shower holder from below as in FIG. 7, while the lower half, as in FIG. 6, is a view from above. The lower strut 7 of the shower holder is still closed in the vicinity of the guidance element 3, but has a recess, so that the lower strut 7 is forked. At the end of the two-portion part of the lower strut 7 the mounting support 5 is shaped, as shown in FIGS. 1–8. The upper strut 4 passes from the guidance element 3 to the mounting support 5 without any gap, but thereagain, an edge 17 can create space for the insertion of the holding head 6.

The adjusting device 10 can be adjusted once and for all following the installation of the shower holder. If a readjustment proves necessary in the course of the, this can also be brought about with the aid of a screwdriver.

Figure 11:
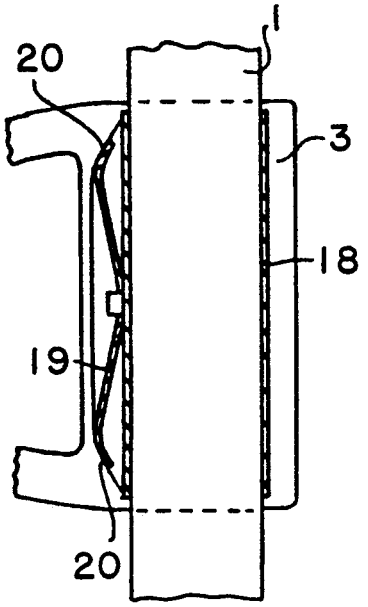
FIG. 11 shows a partial section through another mounting support type.

FIG. 11 shows an embodiment where the interior of the casing of the guidance element 3 contains a tube 18 extending over substantially the entire length of the element 3. On the side of the tube 18 facing the mounting support 5, an upwardly and downwardly extending tongue spring 19 is fixed thereto. The spring 19 can engage with its slightly downwardly bent ends 20 against a correspondingly shaped inner shoulder of the shower holder. This leads to action of the shower holder at right angles to the direction of the wall rod 1, which leads to a non-positive fixing of said holder. It is possible by a choice of spring to ensure that only a limited force is necessary for displacement purposes.

Figure 12:
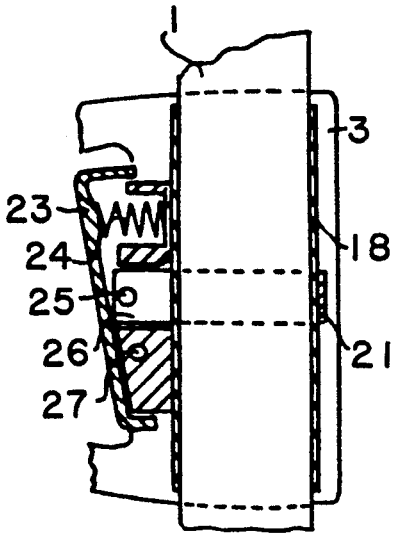
FIG. 12 shows a section of an alternative embodiment.

FIG. 12 shows an embodiment in which the non-positive fixing also takes place through a strip 21. A pushbutton 23 is pivotably connected by means of a spindle 22 traversing the casing of the guidance element 3. The pushbutton 23 is located on the guidance element side facing the mounting support 5, i.e. within the passage 8. In the represented position, the pushbutton is subject to the action of a compression spring 24. A shoulder 26 of the strip 21 is connected to the pushbutton 23 via a spindle 25 and engages on the outside of a tubular element 18 located in the casing of the guidance element 24. The spring 24 presses the pushbutton 23 to the left and therefore the strip 21 onto the outside of the tubular element 18. For releasing the fastening, it is possible for a user to press on the pushbutton 23, so that the strip 21 loosens and the force closure is eliminated.

Figure 13:
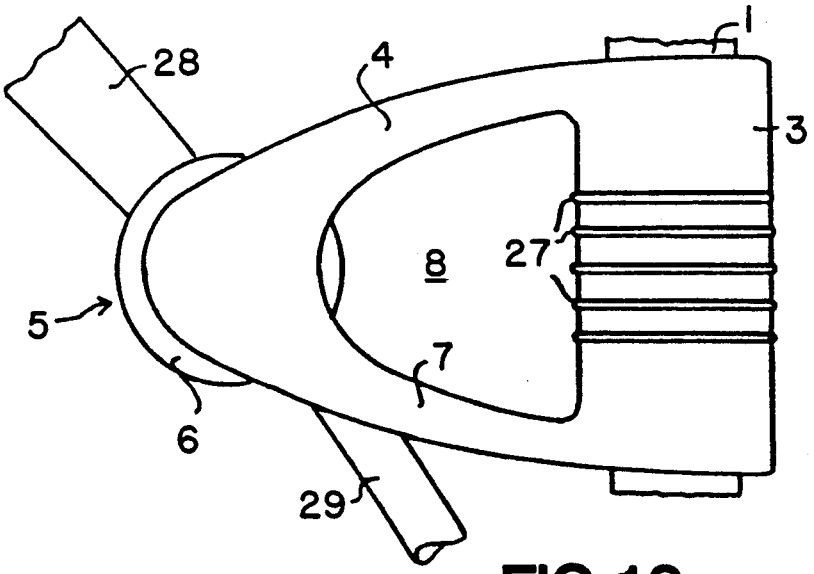
FIG. 13 shows a side view of an alternative embodiment.

FIG. 13 shows another embodiment in which the guidance element 3 is also optionally constructed as a gripping element. To this end, it has several all-round rings, which can be made from a different material than the remaining shower holder. The aforementioned holding head 6 is inserted in the shower holder mounting support and can be pivoted with the aid of a locking mechanism about a horizontal axis. The holding head 6 contains a slightly conical slit, in which can be inserted a shower in the vicinity of its handle 28. In the extension of the handle 28 is provided the shower hose 29, which comes to rest between the two prongs of the fork-shaped lower strut 7. In this way, the shower can be pivoted about a larger angle without the shower hose 29 having to be excessively bent.

The shower holder can be moved along the wall rod 1 with a very limited force. This fine adjustment, which can be brought about either by the spring 19 according to FIG. 11 or by the strip 11 according to FIG. 8, or in some other way, is possible as a result of the long distance along which the guidance element 3 engages on the wall rod 1. If the shower now is inserted in its mounting support, as a result of the considerable distance from the wall rod, there is an increase in the tilting moment, so that despite the limited operating force the shower holder remains stationary. As a result of the construction of the strut webs 4 and 7 beginning at the guidance element 3 and approaching in a roughly triangular manner the mounting support 5, a clip grip is created, which is easy to keep clean and which makes it possible for a user to act on different points of the shower holder for displacing the same. The user can act both on the guidance element 3 and on each of the two struts 4 and 7. The curved shape shown in the drawings is not necessary for this, and a linear configuration of the two struts would also be possible.

It is also possible for the guidance element 3 not to be constructed as a grip, instead being formed by two parts, which are spaced from one another in the longitudinal direction of the wall rod. This would also ensure an easy displaceability.

Figure 4:
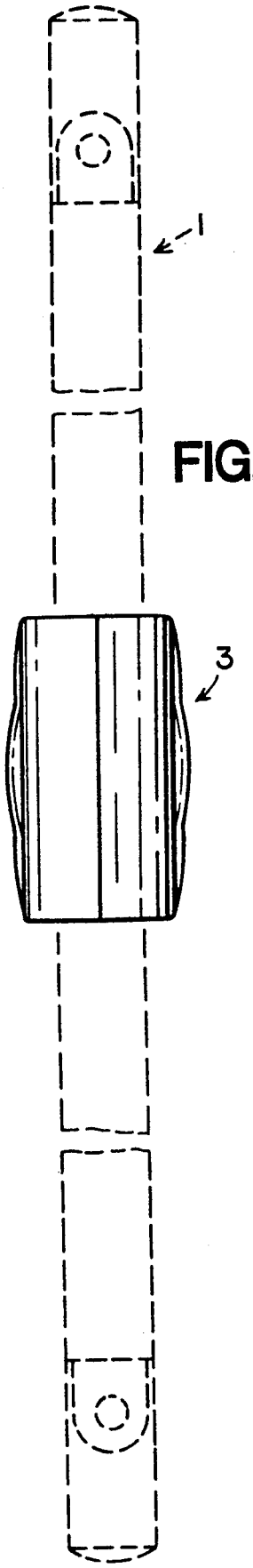
FIG. 4 is a rear elevation view.

The rings surrounding the wall rod in the embodiment according to FIG. 1 and also the tubular element surrounding the wall rod 1 in the embodiments according to FIGS. 4 and 5 can in particular be made from a relatively flexible plastic. As a result of the flexible material, despite the engagement, it is possible to reliably prevent the formation of scratches in the case of frequent movement. However, the easy transverse actuation of the tubular element brought about by the spring 19 or the strip 11 or 21 is distributed over a large surface, so that it does not lead to any traces of wear.

In place of an adjustment device for the holding force which is located in the interior of the clip grip, it is also naturally possible to use an element axially accessible from the top or bottom, e.g. a ring, which engages round the wall rod and is adjustable by means of a fine thread.

In the represented, particularly preferred embodiments of the invention, the spacing of the mounting support from the wall rod is roughly three times as large as the diameter of said rod. The length of the guidance element, i.e. &:he spacing of the two extreme points used for guidance purposes, is also roughly three times the wall rod diameter. In the case of a wall rod with a non-circular cross-sectional shape, in place of the diameter, the transverse dimension can be used as a reference dimension.

We claim:

1. A shower holder for use with a wall rod comprising:

a guidance element, which is displaceably connected to the wall rod and is guided thereon at least two points, whose spacing measured in the longitudinal direction of the wall rod is at least twice as large as the diameter of the wall rod;

a mounting support for holding the shower, which is connected to the guidance element and has a spacing from the guidance element which is at least as large as the spacing of the two guidance points from one another;

the mounting support being connected by means of a strut to the guidance element, and wherein the strut slopes with respect to the direction of the wall rod in such a way that the mounting support, considered in the longitudinal direction of the wall rod, is positioned substantially centrally between the two guidance points.

2. A shower holder according to claim 1, wherein the mounting support includes a pivotable holding device for the shower.

3. A shower holder according to claim 1, wherein the strut is forked.

4. A shower holder according to claim 1, wherein the guidance element surrounds the wall rod at at least the two guidance points and is guided on the outside of said wall rod.

5. A shower holder according to claim 4, wherein the guidance element has a tubular casing, which is engaged on the wall rod.

6. A shower holder according to claim 4, wherein the guidance element contains a tubular element, which can be engaged on the wall rod.

7. A shower holder according to claim 1, wherein the friction between the guidance element and the wall rod is kept within narrow limits.

8. A shower holder according to claim 7, further comprising an adjusting device for adjustment of the friction.

9. A shower holder according to claim 1, wherein a positive fixing of the guidance element on the wall rod can be removed.

10. A shower holder according to claim 6, wherein the guidance element is rotatable with respect to its tubular element.

11. A shower holder according to claim 1, wherein the guidance element is constructed as a gripping element.

12. A shower holder according to claim 1, wherein the guidance element comprises a casing formed from two halves.

13. A shower holder for use with a wall rod comprising:

a guidance element, which is displaceably connected to the wall rod and is guided thereon at at least two points, whose spacing measured in the longitudinal direction of the wall rod is at least twice as large as the diameter of the wall rod;

a mounting support for holding the shower, which is connected to that guidance element and has a spacing from the guidance element which is at least as large as the spacing of the two guidance points from one another, and wherein the mounting support is connected by means of two struts to the guidance element.

14. A shower holder according to claim 13, wherein the two struts converge from the wall rod and the mounting support.

15. A shower holder according to claim 13, wherein the strut leading upwards from the guidance element to the mounting support is forked.

16. A shower holder according to claim 13, wherein a strut is constructed as a grip.

17. A shower holder according to claim 13, wherein the struts and the guidance element form a substantially triangular clip.

18. A shower holder for use with a wall rod, comprising:

a sliding element having an internal passage for displaceably receiving the wall rod;

a mounting support for removably holding a shower structure;

spacing structure for connecting said mounting support to said sliding element at a spaced distance therefrom, said spacing structure being constructed to define an opening in a direction substantially transverse to the alignment of the mounting support and the sliding element, and wherein the spacing structure includes an upper support extending from the sliding element to the mounting support and a lower support extending from the sliding element to the mounting support, the transverse opening being defined between the upper support and the lower support.

19. A shower holder according to claim 18, wherein the lower support is forked to define an opening which converges in a direction from the mounting support to the sliding element.

20. A shower holder according to claim 18, wherein the upper support has a convexly curved upper surface from the sliding element to the mounting support and the lower support has a convexly curved lower surface from the sliding element to the mounting support.

21. The holder according to claim 20, wherein the upper support and the lower support have outer faces in the transverse direction which are substantially planar.

22. The holder according to claim 20, wherein the lower surface of the upper support is concavely curved from the sliding element to the mounting support and the upper surface of the lower support is concavely curved from the sliding element to the mounting support.

23. The holder according to claim 21, wherein a lower surface of the upper support and an upper surface of the lower support are convexly concaved in the transverse direction.

24. The holder according to claim 18, wherein the upper support engages an upper end of the sliding element and the lower support engages a lower end of the sliding element.

25. The holder according to claim 18, wherein the sliding element is substantially cylindrical.

26. The holder according to claim 18, wherein the upper support and the lower support converge on the mounting support so that the mounting support is substantially vertically centered relative to the sliding element.

27. The holder according to claim 18, wherein a substantially spherical member is connected to the mounting support for holding the shower structure, wherein said sphere is held by support structure onto which the upper support and lower support converge.

28. The holder according to claim 18 wherein the sliding element comprises a vertical longitudinal seam.

29. The holder according to claim 19, wherein the forked opening is sufficiently wide adjacent the mounting support to allow movement of the shower structure in the opening.

30. The holder according to claim 18, wherein the upper support and the lower support converge on the mounting support so that the upper support, the mounting support and the lower support form a generally convex, outer circular curvature on an outer surface thereof and a generally concave, inner circular curvature on an inner surface thereof, the radius of the inner circular curvature being larger than the radius of the outer circular curvature.

31. The holder according to claim 18, wherein an upper surface of the upper support, an outer surface of the mounting support and a lower surface of the lower support collectively form a U-shape surface opening toward the sliding element.

32. The holder to according to claim 18, wherein lateral outer surfaces of the mounting support and spacing structure are located substantially in two parallel planes.

33. The holder according to claim 18, wherein a release knob is disposed on the sliding element in the direction of the transverse opening.

34. The holder according to claim 33, wherein the transverse opening is sufficiently large to permit user access to the knob.

35. The holder according to claim 21, wherein the transverse opening is sufficiently large to permit grasping of the cylindrical portion of the sliding element by a user's hand.

36. The holder according to claim 27, wherein the substantially spherical member is pivotable relative to the mounting support.

* * * * *